United States Patent [19]

Dill

[11] Patent Number: 4,557,009

[45] Date of Patent: Dec. 10, 1985

[54] CARBON ELECTRODE CLEANING SYSTEM

[76] Inventor: Raymond J. Dill, 1910 Erskine Dr., Florence, Ala. 35630

[21] Appl. No.: 653,689

[22] Filed: Sep. 21, 1984

Related U.S. Application Data

[63] Continuation-in-part of Ser. No. 510,659, Jul. 5, 1983, Pat. No. 4,472,852.

[51] Int. Cl.[4] ..... B08B 1/00

[52] U.S. Cl. ..... 15/4; 15/89; 15/91; 15/93 R

[58] Field of Search ..... 15/4, 21 E, 89, 91, 15/104.07, 92, 93 R; 29/81 E, 81 F, 81 J; 134/6; 164/158; 204/129.35

[56] References Cited

U.S. PATENT DOCUMENTS 1,597,332 8/1926 Waddell et al. ..... 29/81 E
3,343,986 9/1967 Howery et al. ..... 15/89
4,418,435 12/1983 Arnold ..... 15/4

FOREIGN PATENT DOCUMENTS 0636047 12/1978 U.S.S.R. ..... 15/91

*Primary Examiner*—Edward L. Roberts
*Attorney, Agent, or Firm*—C. A. Phillips; Michael L. Hoelter

[57] ABSTRACT

An electrode cleaning apparatus wherein a carbon electrode is cleaned in a two-step process, the first step being a rough cleaning operation wherein scraper elements scrape the electrode at a first station, and a second step wherein the electrode moves between counter-rotating vertical shafts having flailing elements connected thereto in a second station. The electrode is suspended by a hoist supported on a track which moves the electrode along a path through the first and second stations.

16 Claims, 16 Drawing Figures

CARBON ELECTRODE CLEANING SYSTEM

This application is a continuation-in-part application of Ser. No. 510,659, filed July 5, 1983, now U.S. Pat. No. 4,472,852, entitled "Carbon Electrode Cleaning System."

FIELD OF THE INVENTION

This invention relates generally to the cleaning of electrodes employed in the smelting of aluminum, and more particularly to a plow assembly which scrapes the electrodes clean.

BACKGROUND OF THE INVENTION

During the smelting process in which aluminum is manufactured, large blocks of carbon are employed as anode electrodes. These carbon blocks become consumed through use and are routinely removed from the smelting process and replaced with new ones. The carbon blocks removed are still quite large, and it is desirable to reclaim this removed carbon and use it when forming new carbon electrodes. However, the removed carbon block is encrusted with light colored alumina or cryolite which must be removed before the carbon block can be recycled.

Additionally, smelting plants normally manufacture their own electrodes as a companion function to their mainline smelting operation, and thus the electrode manufacturing process must keep in step with the smelting process. This requires the removal of the alumina and cryolite encrustations quickly and continuously so as not to necessitate the shutting down of the smelting operation due to a lack of new carbon electrodes to replace those consumed.

Generally, the cleaning of electrodes involves a two-step process, the first step being a rough cleaning operation, and the second step being a fine cleaning operation such as that described in applicant's parent application bearing Ser. No. 510,659 concerning a flail assembly.

Accordingly, it is an object of this invention to provide an improved system for rough cleaning large carbon electrodes which is usable either alone or with a fine cleaning system such as a flailing system.

SUMMARY OF THE INVENTION

In accordance with this invention, a plow assembly incorporates a support platform supporting at least one plow for scraping a surface of an electrode. A guide guides a movably supported electrode toward a selected region of the support platform, and once positioned, a restraining assembly restrains the electrode in place. After being restrained, the plow scrapes the electrode and dislodges any surface encrustion from it. A releasing assembly releases the plow from restraint and once again enables the electrode to be moved.

DETAILED DESCRIPTION OF THE DRAWINGS

Figure 1:
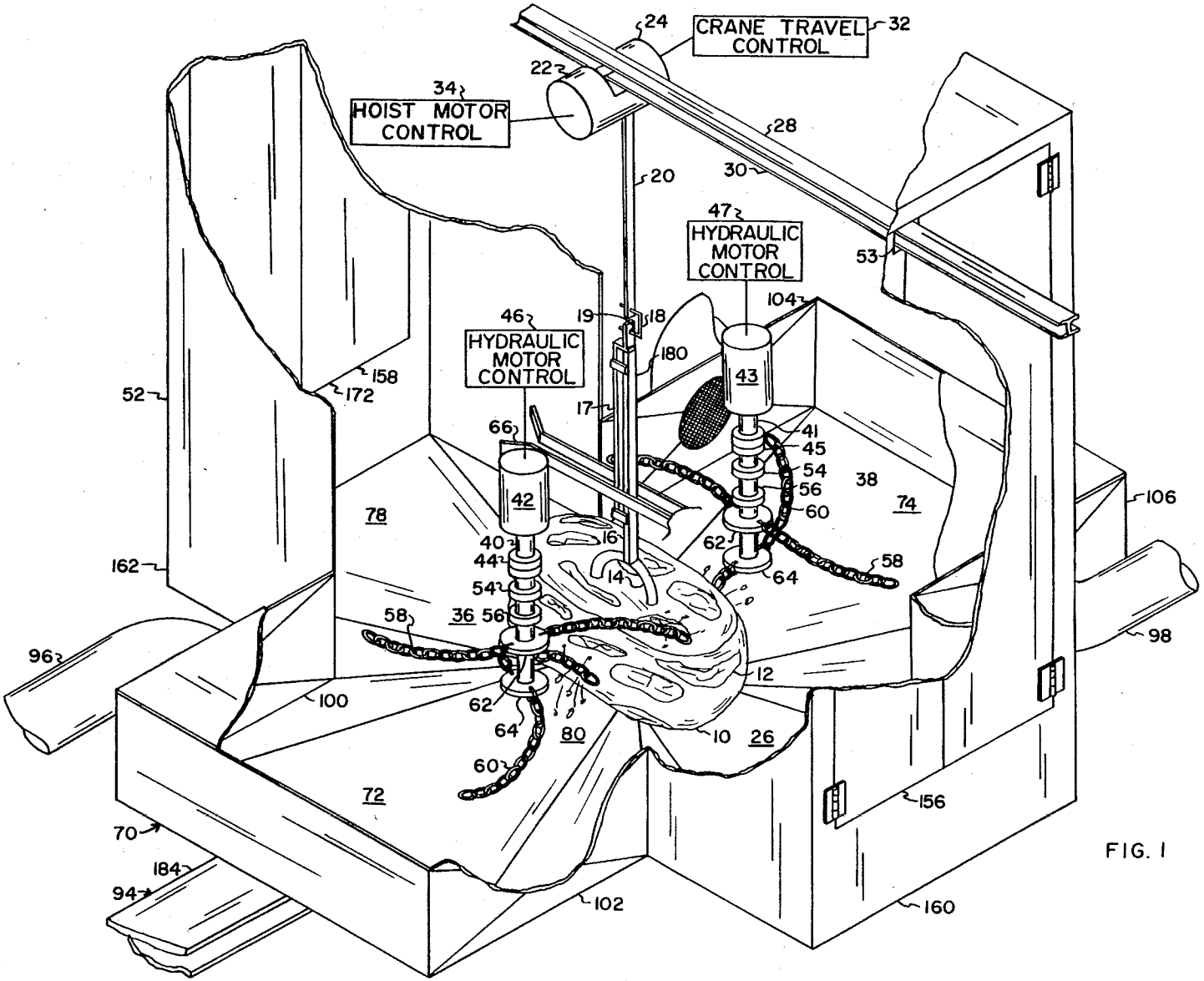
FIG. 1 is a diagrammatic view of an embodiment of the invention.

Referring initially to FIGS. 1–4, there is shown a general arrangement of the components of the applicant's system. Carbon electrode 10 is illustrative of an electrode to be cleaned, it having irregular encrustations 12 of alumina and cryolite built up from its use in the smelting of aluminum. Conventionally, electrode 10 is constructed having a built-in yoke 14 of conductive steel. There extends from yoke 14 an electrically conductive bar 16 which is typically constructed of a lower resistive material than steel, such as aluminum, to reduce electrical losses over its length. Prior to the flailing of electrode 10, a bumper bar 17 is secured along a portion of the length of bar 16, and this bumper bar 17 contains an upper opening 19 through which hook member 18 is inserted.

Electrode 10 is suspended via bumper bar 17 on strap or cable 20 from hoist 22 of traveling crane 24. Crane 24 is supported by a pair of rollers 26 on a generally horizontal track 28 that is formed by an I beam 30. Crane 24 is conventionally driven along track 28 by means of an internal horizontal drive motor (not shown) which drives one or both rollers 26. Horizontal movement is controlled by a conventional crane travel control 32 which supplies power to the horizontal drive motor of crane 24. Vertical movement of the electrode is effected by hoist 22, which includes a conventional drive motor (not shown) for this purpose, vertical movement being controlled by a conventional hoist motor control 34.

Figure 3:
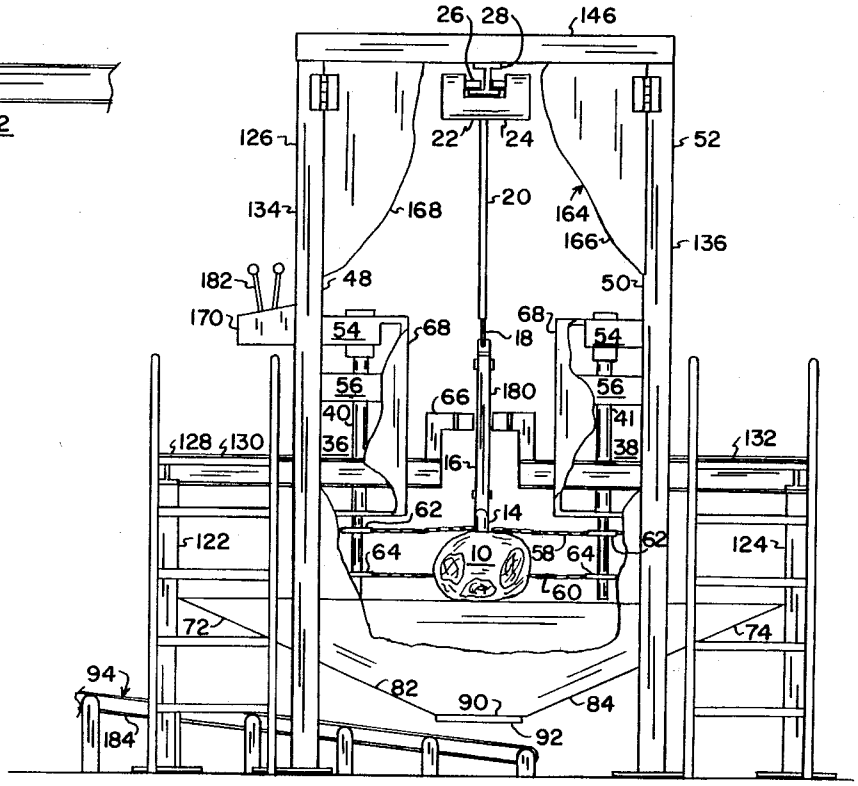
FIG. 3 is a side view, partially cut away, of an embodiment of the invention.

Encrustations 12 of alumina and cryolite on electrode 10 are rapidly and controllably abraded away by two spaced flailing assemblies 36 and 38, these being equally spaced on opposite sides of I beam 30. Each flailing assembly 36 and 38 employs a vertical shaft 40 and 41, respectively. Each shaft 40 and 41 is separately driven by variable speed hydraulic motors 42 and 43. These motors are connected to their respective shafts by conventional shear pin couplings 44 and 45. Each of these motors 42 and 43 are independently controlled by separate hydraulic motor controls 46 and 47, as shown diagrammatically in FIG. 1. One motor control operates a hydraulic motor to rotate the shaft clockwise, while the other motor control operates the other hydraulic motor to rotate the other shaft counterclockwise. Flailing assemblies 36 and 38 are supported on the inner side of opposite side walls 48 and 50 of an elongated enclosure 52 by upper and lower mounted bearings 54 and 56 secured to these side walls 48 and 50 as shown in FIG. 3.

Flailing is effected by an upper pair of flailing chains 58 and an orthogonally positioned lower pair of flailing chains 60. Upper chains 58 are pivotally attached to an upper plate 62 on each shaft 40 and 41, and lower flailing chains 60 are supported on a lower circular plate 64 on each shaft 40 and 41 (FIGS. 1 and 3).

As a means of preventing electrode 10 from getting closer than a seclected minimum distance to the chain holding circular plates 62 and 64, a pair of parallel guide bars 66, one supported from each side wall 48 and 50, is positioned intermediately between flailing assemblies 36 and 38, respectively. These guide bars 66 are longitudinally spaced from each other to permit bars 16 and 17 supporting electrode 10 to be moved between these guide bars with some freedom of movement but not enough to allow upper or lower flailing chains 58 or 60 to snag electrode 10 or bars 16 and 17. The space between guide bars 66 and the combination of both bars 16 and 17 prevent electrode 10 from rotating on cable 20 while it is being flailed. There is illustrated in FIG. 3 an optional cover plate 68 which generally surrounds the upper portion of each flailing assembly 36 and 38. This cover plate 68 is attached by means not shown to each of side walls 48 and 50.

Figure 5:
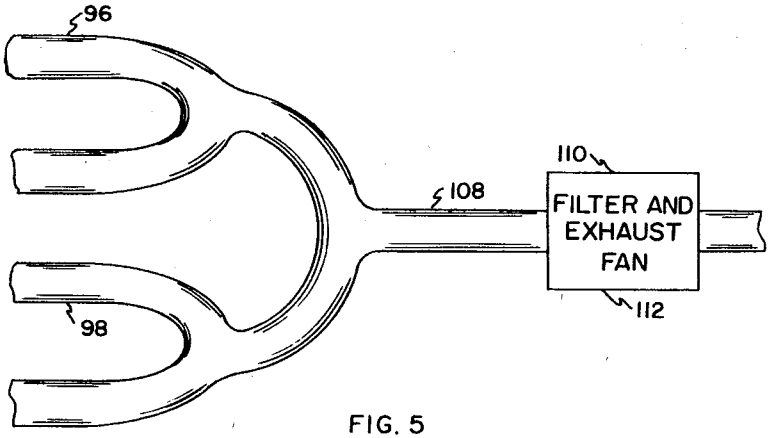
FIG. 5 is a diagrammatic view, partially cut away, of the particulate filter system.

The flailing operation occurs within hopper 70. Hopper 70 is horizontally configured generally in the shape of a cross wherein there are four outer sectors 72, 74, 76 and 78 and a central or middle sector 80. Track 28, which carries crane 24 and thus electrode 10, extends centrally over and across sectors 76 and 78 and central sector 80. These four outer sectors have sloping bottom surfaces 82, 84, 86, and 88 which extend downward to a central bottom opening 90, as particularly shown in FIG. 2. Opening 90 has turned-down flanges 92 around its perimeter to guide the flow of debris out of hopper 70. Belt conveyor 94 is positioned directly under opening 90 to receive this debris via gravity, and conveyor 94 transports this debris to a storage bin (not shown). The flailed material is later mechanically crushed and returned to the smelting furnace where it is added back into the smelting process. By this configuration, debris from the flailing operation is efficiently and effectively removed from hopper 70. Further, this configuration enables the connection of a pair of exhaust ducts 96 and 98 closely proximate to the high dust regions in opposite sectors 72 and 74 of hopper 70. The removal of dust via these ducts materially enhances the visibility of the cleaning operation. Thus, as shown, one pair of ducts 96 is in opposite walls 100 and 102 of sector 72, and a second pair of exhaust ducts 98 is in opposite walls 104 and 106 of sector 74. These ducts 96 and 98 are connected through duct pipes 108 shown in FIG. 5 to a central filter 110, and exhaust fan 112 is connected to filter 110 which draws dust particles from hopper 70 into filter 110. Filter 110 includes a collection reservoir for dust drawn into it, which is then appropriately disposed of.

Figure 2:
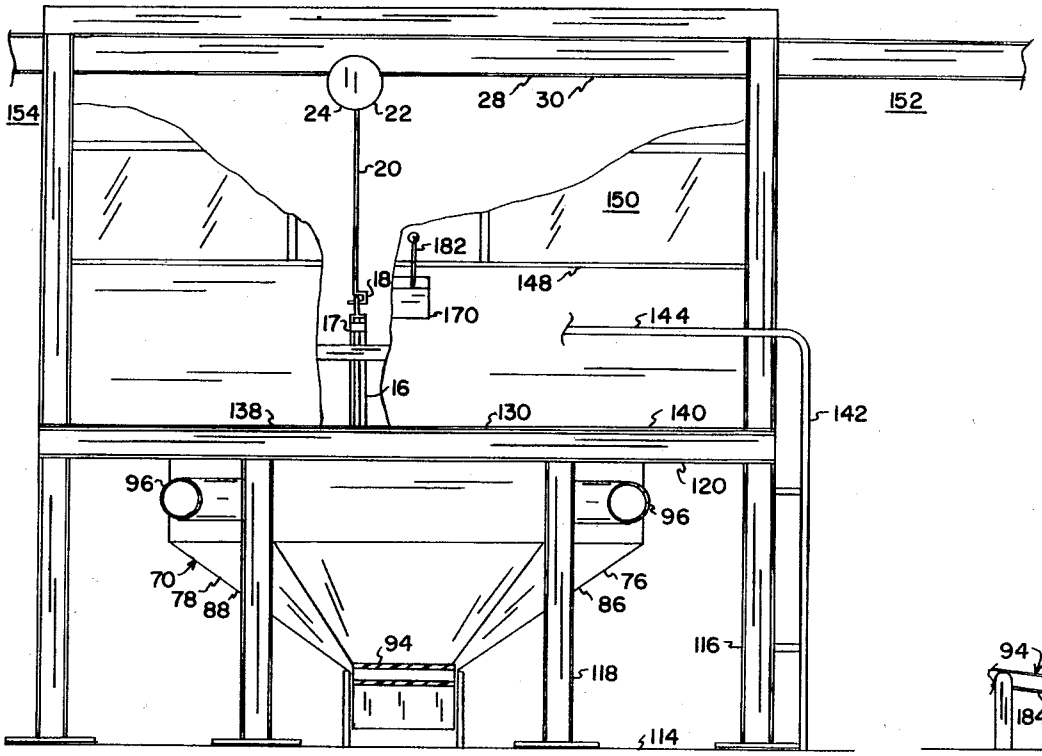
FIG. 2 is a front view, partially cut away, of an embodiment of the invention.

Referring particularly to FIGS. 2 and 3, hopper 70 is supported above the floor or ground 114 by structural frame 116, which is bolted or welded together in a conventional fashion. Frame 116 consists of upright support beams 118 and lateral support beams 120 which are generally formed of structural I beams. Structural frame 116 also connects to and supports enclosure 52, which extends above and around hopper 70.

Discrete base portions 122 and 124 of enclosure 52 extend over sectors 72 and 74, and raised or side wall portion 126 extends as a rectangular cover around and over outer sectors 76 and 78 and central sector 80. The upper surface 128 of each base portion 122 and 124 serves as a portion of the floor of one of elevated walkways 130 and 132. Each walkway 130 and 132 extends along each side 134 and 136 of the raised or side wall portion 126 of enclosure 52. Floor regions 138 and 140 extend laterally on each side 134 and 136 of enclosure 52 from base portions 122 and 124 and completes each walkway 130 and 132. Ladders 142 on each side 134 and 136 of enclosure 52 are supported by structural frame 116 and provide access to one of walkways 130 and 132. Each ladder 142 provides a support for outer hand rails 144 which extend along each of walkways 130 and 132. Raised side wall portion 126 and top 146 of enclosure 52 provide a dust and debris cover. This enclosure 52 generally prevents the escape of dust and debris from within enclosure 52, and portions of it, particularly side wall portion 126 and base portions 122 and 124, are typically constructed of steel plate. One exception is that there is a viewing area 148 on each of opposite sides 134 and 136 of enclosure 52 which is constructed of a reinforced transparent material 150, such as a steel reinforced acrylic plate.

The loading and unloading of the electrodes onto and from hoist 22 are typically effected from a loading and unloading zone 152 and 154 as illustrated in FIG. 2. Accordingly, track 28 extends through enclosure 52 via opening 53 (FIG. 1) and between these zones 152 and 154. To accommodate this configuration, closable openings 156 and 158 are provided on each of opposite sides 160 and 162 of enclosure 52. One of these is illustrated in FIG. 3 by door 164 which is formed of two swinging door units 166 and 168, each being spring biased to normally remain in a closed position but being openable upon being engaged by an electrode as it is moved inward or outward by crane 24.

Crane travel control 32 and hoist motor control 34 for the control of crane 24 and hoist 22, respectively, and hydraulic motor controls 46 and 47, which control the speed of rotation of vertical shafts 40 and 41 in each of flailing assemblies 36 and 38, are located in control panel 170 centrally positioned on side 134 of enclosure 52. Control panel 170 is positioned along walkway 130 just below transparent viewing area 148 in side 134 of enclosure 52. This allows an operator to effect control of the operation while looking down inside hopper 70.

To examine the operation of the electrode cleaning system of this invention, a partially consumed carbon electrode is illustrated in FIGS. 1–4 by carbon electrode 10 having on it an encrustation 12 of alumina and cryolite. Hoist control 34 and crane travel control 32 are activated from control panel 170 by an operator standing upon walkway 130 to lift electrode 10 upward. This is accomplished by inserting hook member 18 into opening 19 in the upper end region 180 of bumper bar 17. Once inserted, crane 24 is operated to suspend electrode 10 above the ground 114 from track 28, and then hoist 22 is activated to move this suspended electrode 10 through door units 166 and 168 which separate electrode loading zone 152 from the interior of the raised portion 126 of enclosure 52. At this time, both hydraulic motor controls 46 and 47 are engaged by controls 182 to operate hydraulic motors 42 and 43 in order to rotate vertical shafts 40 and 41 in flailing assemblies 36 and 38, respectively. Generally, electrode 10 is moved along track 28 by hoist 22 until it is suspended between guide bars 66 and directly above upper pairs of flailing chains 58. Then, crane 24 lowers electrode 10 between vertical shafts 40 and and 41 and within flailing range of upper and lower chains 58 and 60 to remove the encrustations 12 of alumina and cryolite on electrode 10. While being flailed, electrode 10 is maneuvered forward and backward by hoist 22 and upward and downward by crane 24 to insure that all of encrustation 12 is removed.

Figure 6:
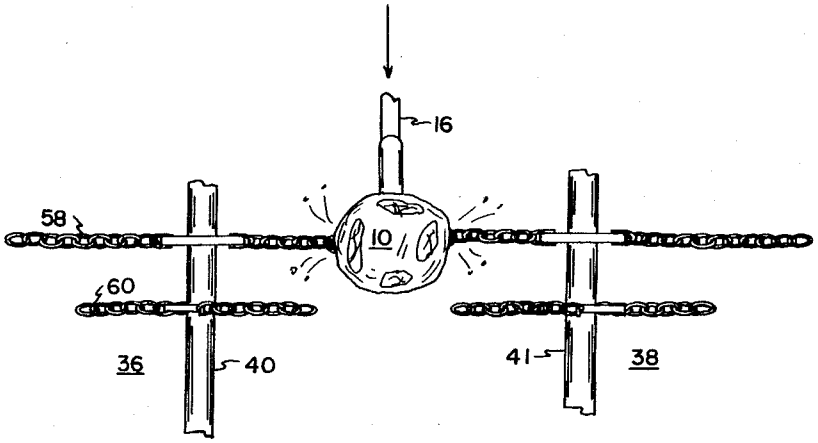
FIG. 6 is a side view of the operation of the flailing assemblies.

Referring now to FIG. 6, electrode 10 is shown being lowered toward flailing chains 58 and 60, with its bottom side being positioned within the flailing range of upper flailing chains 58. The bottom side of electrode 10, as well as portions of its right and left sides, is partially flailed while passing through the flailing range of upper flailing chains 58, and the flailing process for these right, left, and bottom sides is completed as they pass within the flailing range of lower flailing chains 60.

Figure 7:
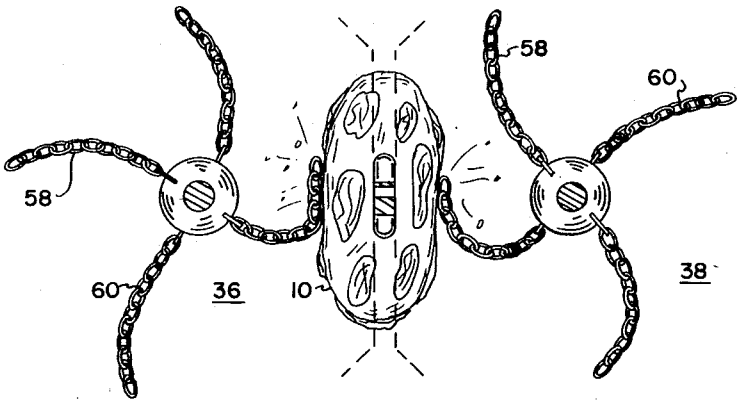
FIG. 7 is a top view of the operation of the flailing assemblies.
Figure 4:
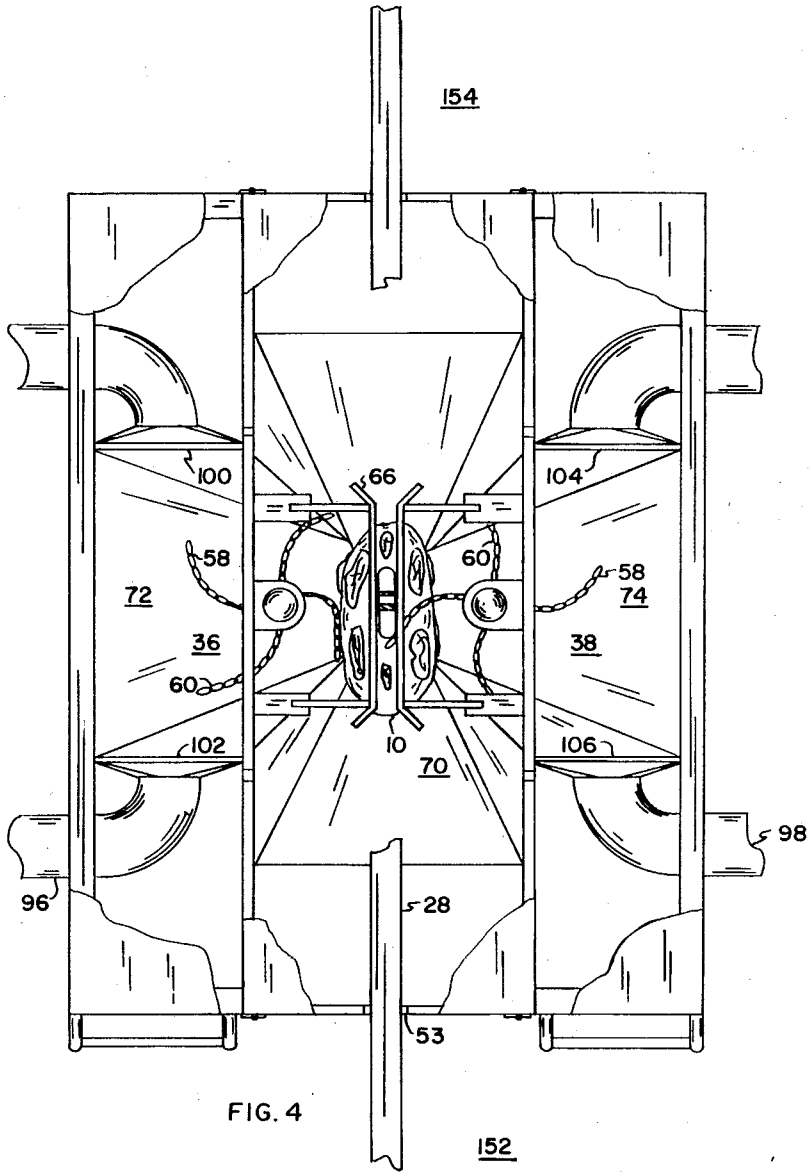
FIG. 4 is a top view, partially cut away, of an embodiment of the invention.
Figure 8:
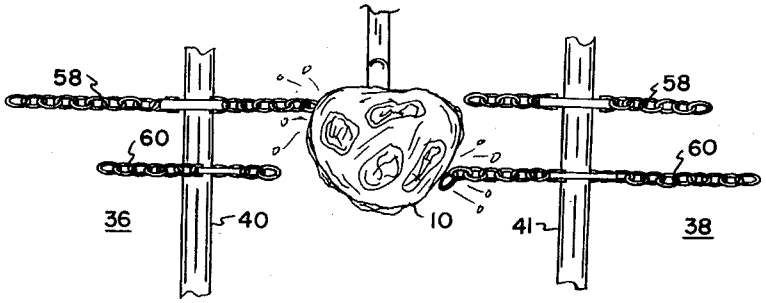
FIG. 8 is a side view of the operation of the flailing assemblies.

Referring now to FIGS. 7 and 8, the bottom side of electrode 10 has passed through the flailing range of lower flailing chains 60, and its right and left sides are currently being flailed by both upper and lower flailing chains 58 and 60, respectively. This flailing process continues until encrustations 12 on these sides have been removed.

Figure 9:
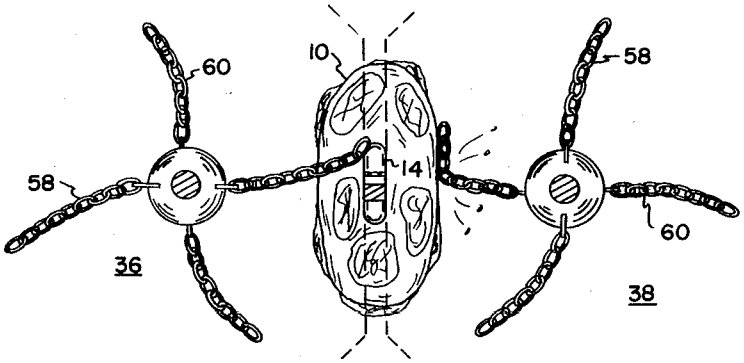
FIG. 9 is a top view of the operation of the flailing assemblies.
Figure 10:
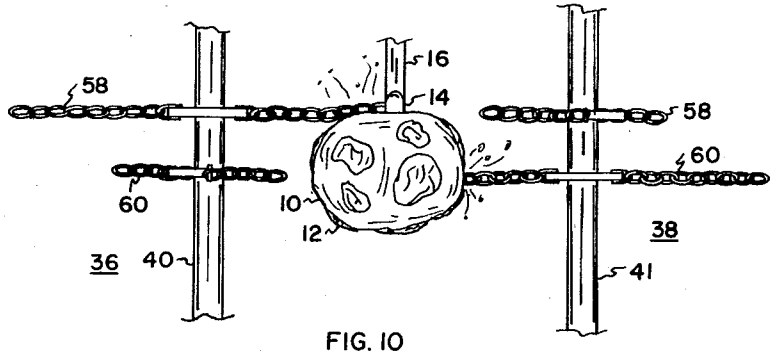
FIG. 10 is a side view of the operation of the flailing assemblies.

FIGS. 9 and 10 illustrate electrode 10 having its top surface flailed. Upper flailing chains 58 are of a length which allows them to partially extend around and through yoke 14 and to clean any encrustation 12 found there. This length is not so great, however, as to allow these upper chains to wrap around yoke 14, thereby snagging electrode 10 and pulling it inward toward their respective flailing assembly. Guide bars 66 (FIG. 9) keep electrode 10 sufficiently spaced from flailing assemblies 36 and 38 to prevent any snagging by upper flailing chains 58. Thus, as the top of electrode 10 passes through the flailing range of these upper chains 58, any encrustations 12 found there are removed.

Depending upon the overall length of electrode 10, crane 24 may be pitched forward or backward to move electrode 10 forward or backward while it is being flailed in order to clean along its entire length. Furthermore, as the front region of the left and right sides of electrode 10 are being cleaned, the front side of electrode 10 is simultaneously being cleaned. Similarly, as the back or rear regions of the left and right sides of electrode 10 are being cleaned, the back or rear side of electrode 10 is also being cleaned.

After all sides of electrode 10 are cleaned, whether or not the operator was required to lower the electrode or move it forward or backward to accomplish this task, electrode 10 is maneuvered away from both the upper and lower pairs of flailing chains 58 and 60 by hoist 22 and crane 24. The operator is able to determine whether electrode 10 is cleaned by his observance of the flailing operation through viewing area 148 in either side 134 or 136 of enclosure 52. Thus, once the unspent black carbon is showing on all sides, the operator manipulates controls 182 in control panel 170 to transfer electrode 10 out swinging doors 172 in side 162 of raised portion 126 of enclosure 52 via track 28. Once outside enclosure 52 and in electrode unloading zone 154, electrode 10 is set back on the ground 114, and hook member 18 is removed from opening 19 in bar 17. Hoist 22 and crane 24 then pass back through enclosure 52 on track 28 to electrode loading zone 152 where another carbon electrode (not shown) is hoisted above the ground and enters enclosure 52 to begin the flailing process all over again.

The alumina and cryolite encrustations 12 that are removed from electrode 10 during the flailing process are contained as much as possible within enclosure 52. The larger non-airborne granules which fall down toward the bottom of hopper 70 roll or slide toward bottom opening 90 where they fall onto belt 184 of conveyor 94. This conveyor transports these granules to a storge bin or crusher (not shown), depending on their size, and they are later transported back to the smelter where they are added back to the smelter furnaces.

The smaller airborne particulates are sucked out of hopper 70 via ducts 96 and 98 in hopper sections 72 and 74. These airborne particulates are drawn along inside duct pipe 108 by exhaust fan 112 to filter 110 where they are collected and then disposed of.

As previously mentioned, flailing assemblies 36 and 38 are separately driven. This is accomplished by having each vertical shaft 40 and 41 connected to separate hydraulic motors 42 and 43 via shear pin couplings 44 and 45, respectively. Additionally, separate motor controls 46 and 47 for each motor 42 and 43 are located in control panel 170. By varying the speed of rotation for vertical shafts 40 and 41, an operator is able to vary the rate of cleaning of electrode 10. Thus, if electrode 10 is only slightly encrusted, the rate of rotation of flailing assemblies 36 and 38 can be adjusted accordingly. Alternately, should one side of electrode 10 be encrusted thicker than the other side, the rate of rotation between these flailing assemblies 36 and 38 can be altered accordingly. Thus, with skill, an operator is able to flail a portion of the surface of an electrode only so long as is needed and no more so as to minimize the loss of the usable carbon while insuring the removal of all undesired encrustations 12.

Figure 11:
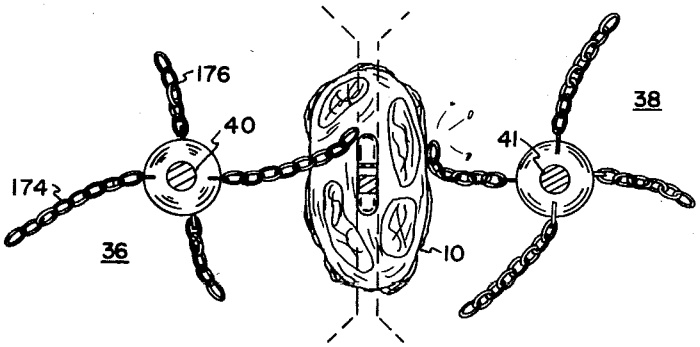
FIG. 11 is a top view, partially cut away, of an alternate embodiment of the flailing chains.

An alternate embodiment of the applicant's system is shown in FIG. 11. In this embodiment, the length of upper flailing chains 174 are greater in length than lower flailing chains 176 in each flailing assembly 36 and 38. These differences in length provide for more efficient cleaning of the electrode surfaces. This is because in the flailing process, it is the sharp whip-like action of the flail against the workpiece which causes the workpiece to come clean. When a long flail strikes a workpiece, the excess of this longer flail tends to be dragged across the workpiece rather than whipping it as preferred. Thus, electrode surfaces closer to rotating shafts 40 and 41 (the right and left sides) are more efficiently cleaned with a shorter chain, while obviously, electrode surfaces farther from rotating shafts 40 and 41 (the top, bottom, front, and back sides) require a longer chain. Thus, different length chains insure that regardless of the distance between the to-be-cleaned electrode surface and the rotating shaft, each surface is capable of being subject to a whip-like action rather than a dragging action by the flailing chains. The ability of the operator to control the position of the electrode while it is being flailed permits each surface to be cleaned at its most effective and efficient rate.

Figure 12:
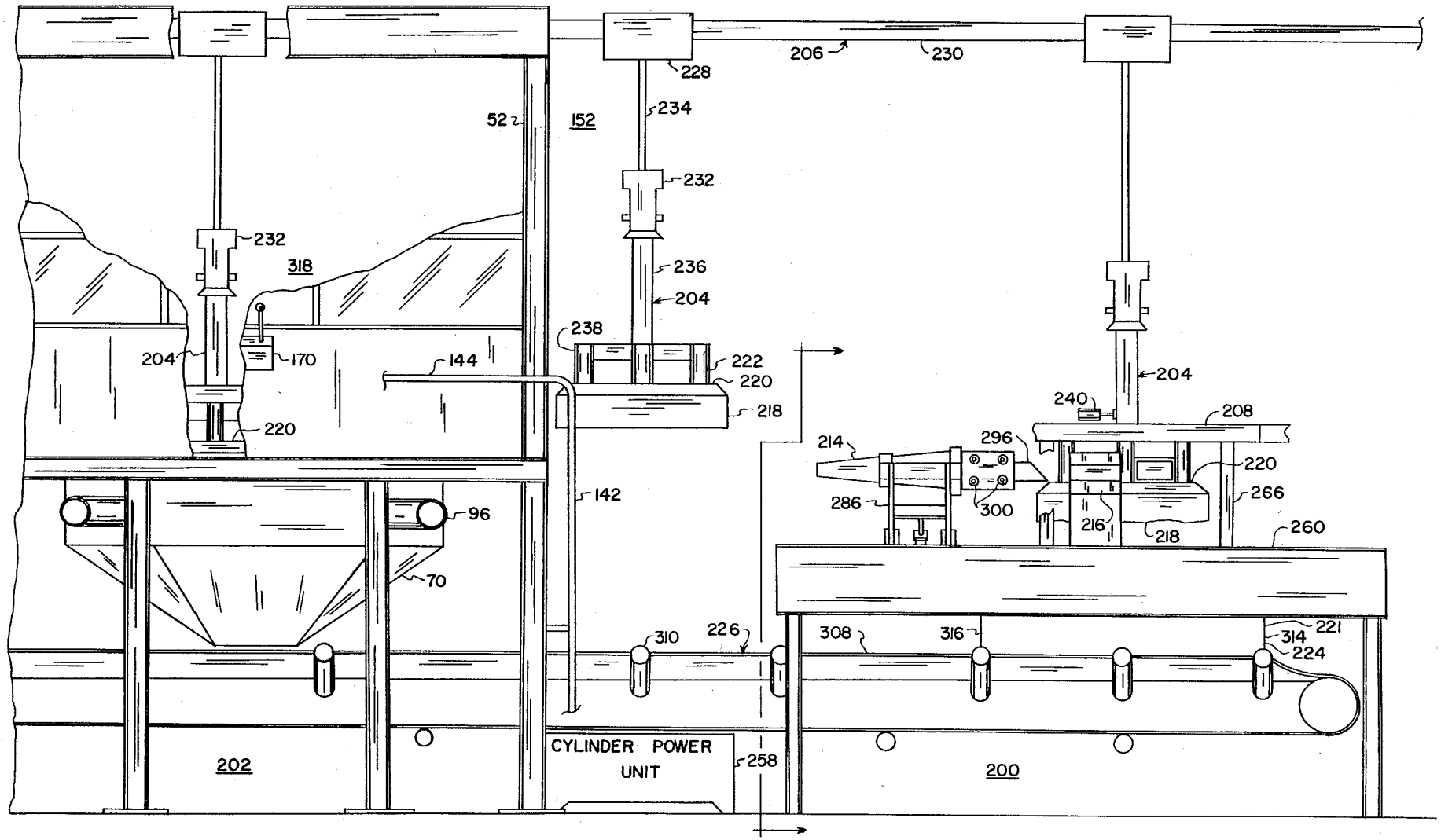
FIG. 12 is a side pictorial view, partially cut away, of the plow assembly minus the corner braces for clarity, merged with FIG. 2 with the conveyor rotated 90°.
Figure 13:
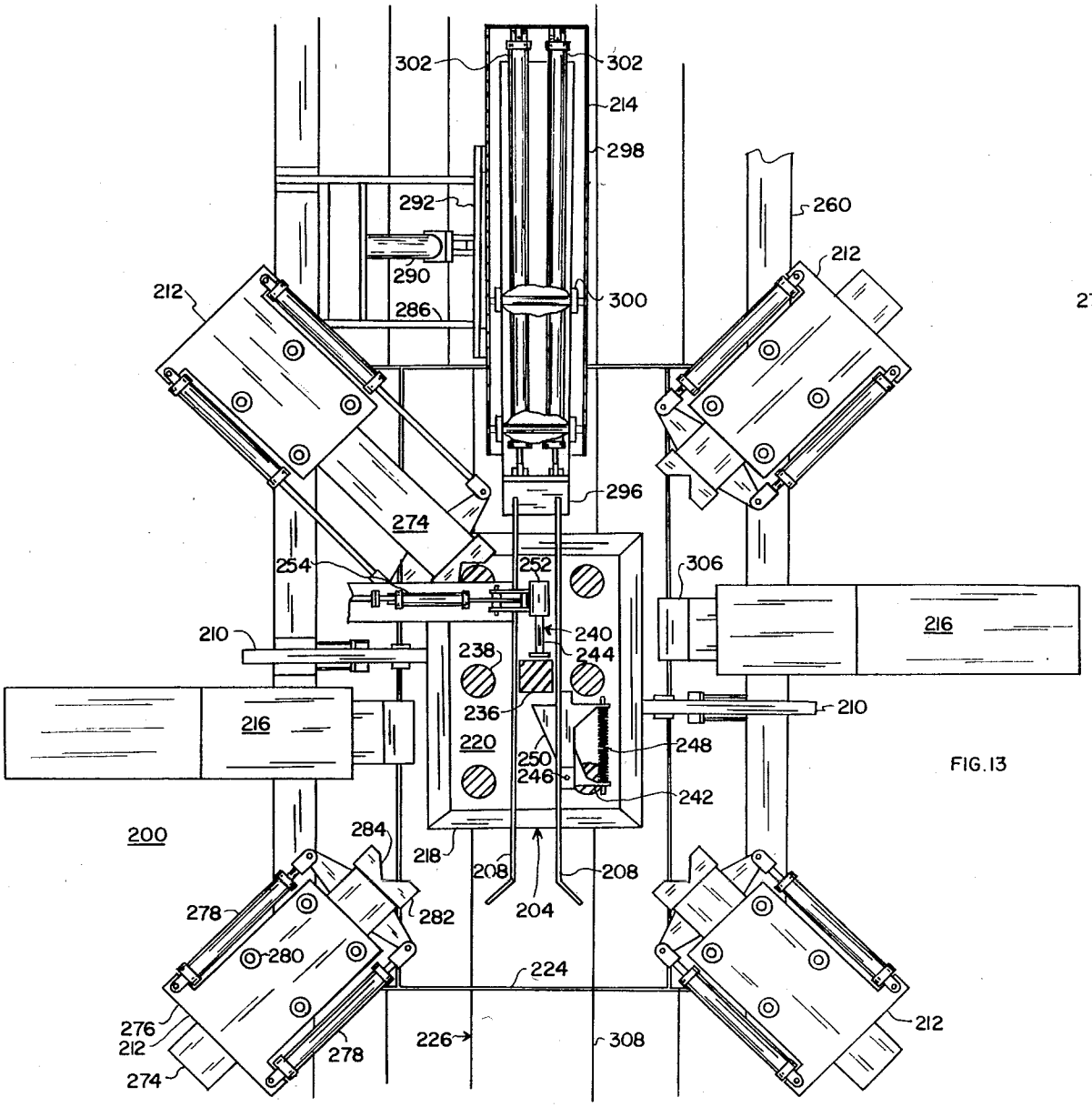
FIG. 13 is an enlarged planar pictorial view, partially cut away, of the plow assembly.

Referring now to FIG. 12, there is a shown a side elevational view of plow assembly 200 in conjunction with flail assembly 202. A carbon electrode 204 is first conveyed, via overhead conveyor 206, toward plow assembly 200 where electrode 204 is temporarily restrained between guide bars 208 by lever arms 210 (FIG. 13) and corner braces 212 (FIG. 13). Once restrained, sweep plow 214 and main plows 216 are extended to break up the encrustation of alumina or cryolite accumulated on carbon block 218 during the smelting process. Afterwards, electrode 204 is released from restraint and conveyed a short distance to flail assembly 202. During the flailing process, the top surface 220 of carbon block 218 is fine cleaned to further remove any remaining alumina encrustation from around yoke 222. The removed alumina encrustation is collected in hopper 224 underneath plow assembly 200 or hopper 70 surrounding flail assembly 202 and deposited upon belt conveyor 226 for recycling in the smelting process. After cleaning, electrode 204 is conveyed via overhead conveyor 206 out of enclosure 52 ready for the recycling of carbon block 218.

Overhead conveyor 206 is of the power and free type enabling it to suspend a restrained electrode at a selected location until the electrode is free of restraint, and then continue to convey the electrode onward to other locations or work stations. This overhead conveyor 206 includes a series of individual carriages 228 supported by rail 230 with each carriage 228 suspending a coupler 232 via strap or cable 234 which couples to one end of elongated rod 236 of electrode 204. This elongated rod 236 in turn connects to a yoke 222 which has a series of symmetrically spaced posts 238 embedded in carbon block 218. During the smelting process, this carbon block becomes encrusted with light colored, brittle alumina or cryolite which is in sharp contrast to the dark carbon block 218 and to recycle this carbon, this encrustation must be removed.

Referring now also to FIG. 13, electrode 204, or more specifically elongated rod 236, is moved by overhead conveyor 206 between guide bars 208 until engaging latching assembly 240. Latching assembly 240 is supported adjacent guide bars 208 and is configured having a flat spring biased plate 242 and a stop plunger 244. Plate 242 extends through one of guide bars 208 and is pivotally supported by pin 246. Spring 248 biases plate 242 against one of guide bars 208, and as rod 236 is moved between guide bars 208, it engages tapered surface 250 of plate 242 and pivots this plate about pin 246 against the bias of spring 248. When rod 236 passes plate 242, spring 248 is released and shaps plate 242 back to the position shown, thereby preventing rod 236 from moving backward out from between guide bars 208.

Figure 14:
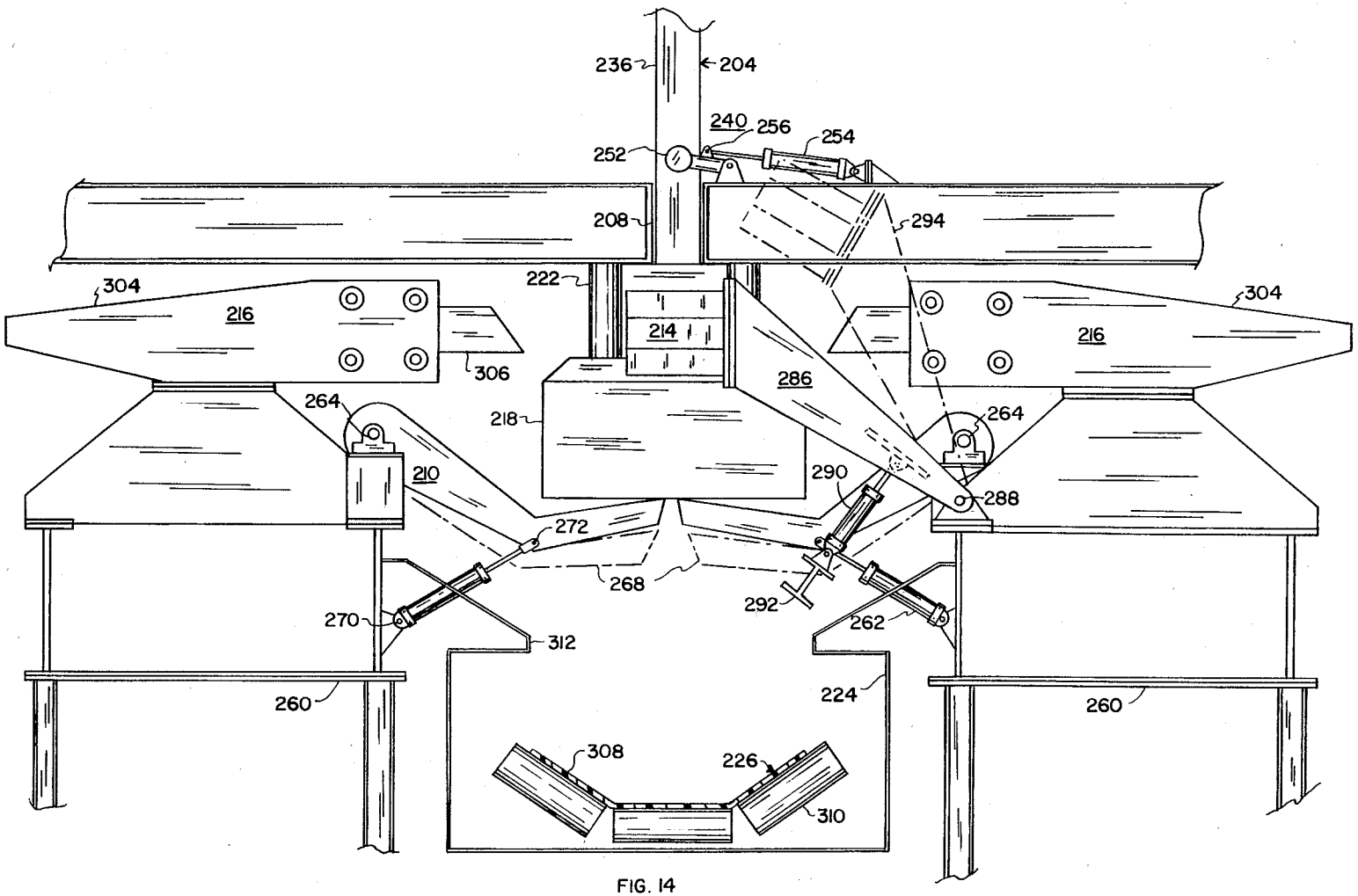
FIG. 14 is an end pictorial view, partially cut away, of the plow assembly minus the corner braces for clarity and showing the alternate positions of the sweep plow and the level arms.

Stop plunger 244, as shown in FIGS. 13 and 14, is positioned above and between guide bars 208 and restricts the forward movement of electrode 204. Rod 236 engages spring biased plunger 244 causing it to slide into housing 252, thereby slowing down and stopping the forward movement of electrode 204. Once restrained, electrode 204 and carriage 228 becomes disengaged from power and free overhead conveyor 206, and rod 236 is suspended between stop plunger 244, flat plate 242 and guide bars 208. When the plowing operation is completed, cylinder 254 is operated to rotate both housing 252 and stop plunger 244 upward about pin 256 out from between guide bars 208 to release restraint of electrode 204. Afterward electrode 204 becomes, once again, powered by power and free overhead conveyor 206 and is moved from between guide bars 208. Cylinder 254 is powered by cylinder power unit 258 (FIG. 12), which may be manually or automatically operated.

After rod 236 engages latching assembly 240 electrode 204 becomes disengaged from overhead conveyor 206, carbon block 218 is vertically restrained in place within plow assembly 200 by hinged lever arms 210 (FIG. 14) underneath carbon block 218. These lever arms 210 are secured to support platform 260 and are pivoted by cylinders 262 about pins 264 to engage the bottom of carbon block 218 and move it upward until the top of yoke 222 is biased against the bottom of guide bars 208 as shown. Guide bars 208 are fixedly secured to support platform 260 via posts 266 (FIG. 12), and thus carbon block 218 is securely sandwiched between these guide bars 208 and lever arms 210. When the plowing operation is completed, lever arms 210 are rotated about pins 264 to the position shown by dotted lines 268, thereby releasing engagement with electrode 204. Cylinders 262, which are hinged at pins 270 and 272, are secured to support platform 260 and are powered via cylinder power unit 258 (FIG. 12). Plow assembly 200 may be automated such that once electrode 204 is restrained between guide bars 208 and latching assembly 240, cylinders 262 and thus lever arms 210 begin to move carbon block 218 upward.

Figure 15:
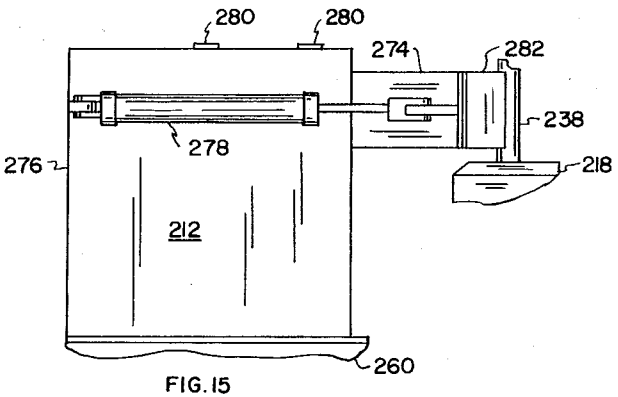
FIG. 15 is a side elevational view, partially cut away, of a corner brace illustrating the extension of the boom and its restraint of an electrode.

Once electrode 204 is vertically restrained in place, booms 274 of each of the four corner braces 212 (FIGS. 13 and 15) supported on support platform 260 extend to nearly contact (within approximately ½") the four corner posts 238 of yoke 222. These booms 274 extend from their respective corner brace housing 276 and are moved by cylinders 278 such as those secured on opposite sides of each corner brace housing 276. Each boom 274 is supported by two pairs of roller supports 280 secured to each housing 276 which guide and support boom 274. The head 282 of each boom 274 has a "V" notch 284 therein that nearly makes contact with the corner posts 238 of yoke 222. Cylinders 278 of each corner brace 212 are powered via cylinder power unit 258, and this operation may be manual or it may begin automatically either following or during the upward pivoting of lever arms 210. These cylinders are generally sized so as to be capable of generating up to 50,000 pounds of force. Thus, when booms 274 of each corner brace 212 are extended and lever arms 210 are pivoted upward, electrode 204 is essentially fixedly held in place with little movement permitted.

Sweep plow 214 and its supporting frame 296 are hinged at pin 288. Cylinder 290 braced against beam 292 of support platform 260 pivots both sweep plow 214 and support frame 286 between the position shown and that shown by dotted lines 294 (FIG. 14). The operation of cylinder 290 may be manual or it may be automated so as to begin during or upon the horizontal and vertical restraint of electrode 204. Additionally, cylinder 20 is powered via cylinder power unit 258 (FIG. 2).

When a sweep plow 214 is in its lowered position, the bottom of sweep plow blade 296 is positioned at nearly the same elevation as at the top of the vertically and horizontally braced carbon block 218 (FIG. 12). Sweep plow blade 296 is tapered at an angle of approximately 60° and is supported within sweep plow housing 298 by two pair of roller supports 300. These supports 300 are similar to the vertical supports 280 of corner braces 212. Plow blade 296 is extended by a pair of cylinders 302 within sweep plow housing 298, and these cylinders are sized so as to be capable of generating up to 12,500 pounds of force and are powered via cylinder power unit 258.

Referring once again to FIG. 14, sweep plow 214 is shown in its lower position with cylinder 290 being retracted. Main plows 216 on opposite sides of electrode 204 are similar in construction to sweep plow 214 and are fixedly secured to support platform 260. The hydraulic cylinders (not shown) contained within main plow housings 304, however, are capable of generating a force of up to 45,000 pounds, and the elevation of the lower edge of main plow blades 306 is the same as that of sweep plow blade 296. This elevation, as previously described, is approximately that of the top 220 of carbon block 218, and main plow blades 306 are also tapered at an angle of approximately 60°. These main plow cylinders are powered via cylinder power unit 258 (FIG. 12), and they may be manually or automatically operated.

Belt conveyor 226 is of conventional construction and operation and extends in a generally horizontal direction underneath both plow assembly 200 and flail assembly 202. Top belt 308 of belt conveyor 226 may be flat or top rollers 310 may configure belt 308 as shown in FIG. 14. Belt conveyor 226 collects the alumina or cryolite encrustation removed from electrode 204 during the plowing operation and conveys this material elsewhere to be recycled and reused in the smelting of aluminum.

Hopper 224 extends underneath electrode 204 and directs any debris removed by plows 214 or 216 toward opening 312 and onto belt conveyor 226. This hopper 224 is supported by support platform 260, and belt conveyor 226 passes through side walls 314 and 316 of hopper 224 to convey the collected debris away from hopper 224.

During operation, electrode 204 is conveyed via power and free overhead conveyor 206 between guide bars 208 to engage latching assembly 240. Once electrode 204 is centered, lever arms 210 are pivoted upward by cylinders 262 to engage the bottom surface of carbon block 218. These cylinders 262 then lift electrode 204 upward until the top of yoke 222 engages the bottom of fixed guide bars 208. The continued upward pressure of electrode 204 against fixed guide bars 208 thereby restricts the vertical movement of electrode 204. To similarly restrict the horizontal movement of electrode 204, the corner booms 274 of the four corner braces 212 are extended by cylinders 278 to nearly contact their respective corner posts 238 of yoke 222. "V" notch 284 of each boom 274 partially surrounds these corner posts 238, thereby restricting the horizontal movement of electrode 204. The operation of corner braces 212. latching assembly 240, and lever arms 210 may be manually operated or they may be automatically operated using such devices as proximity switches, pressure switches, or timers in conjunction with a computer or other control, such as control 170 (FIG. 12).

Once electrode 204 is restrained in place, main plows 216 extend across the top of carbon block 218 and pass through and underneath yoke 222 between posts 238. The operation of main plow cylinders (not shown) may be automated by using proximity switches, pressure sensors, timers or the like. Any alumina or cryolite encrustation on carbon block 218 is forced off carbon block 218 by the plowing action of main plow blades 306. After main plow blades 306 have plowed across the top of carbon block 218 to their respective other side, blades 306 are retracted back within housing 304 and no longer engage electrode 204.

During or prior to this operation, sweep plow 214 is pivoted from its upper position to its lower position. After main plow blades 306 are retracted, sweep plow blade 296 is extended to plow across the top of carbon block 218 through yoke 222 between posts 238. Sweep plow 214 also pushes any previously plowed and broken alumina into hopper 224. Upon being either fully extended or reaching the opposite side of carbon block 218, sweep plow blade 296 is retracted back within sweep plow housing 298. Once retracted, cylinder 290 is operated to pivot sweep plow 214 upward to the position shown by dotted lines 294 in FIG. 14.

As sweep plow 214 is being pivoted or immediately thereafter, corner brace booms 274 of corner braces 212 are retracted away from yoke 222 and lever arms 210 are pivoted to the position shown by dotted lines 268 in FIG. 14. Thereafter, electrode 204 once again is suspended from power and free overhead conveyor 206 and cylinder 254 of latching assembly 240 pivots housing 252 and stop plunger 244 upward away from guide bars 208, thereby releasing electrode 204 from restraint by plow assembly 200. Once free, overhead conveyor 206 moves electrode 204 away from plow assembly 200 where it may be subsequently flailed or otherwise prepared for recycling.

The operation of all cylinders, overhead conveyor 206, and belt conveyor 226 may be fully controlled by a central control panel, such as control panel 170 (FIG. 12), and this control may be fully automated, thereby not requiring an operator during the plowing operation. Ideally, one complete cycle of plow assembly 200, and thus one electrode being cleaned, would be accomplished in approximately 50 seconds.

Figure 16:
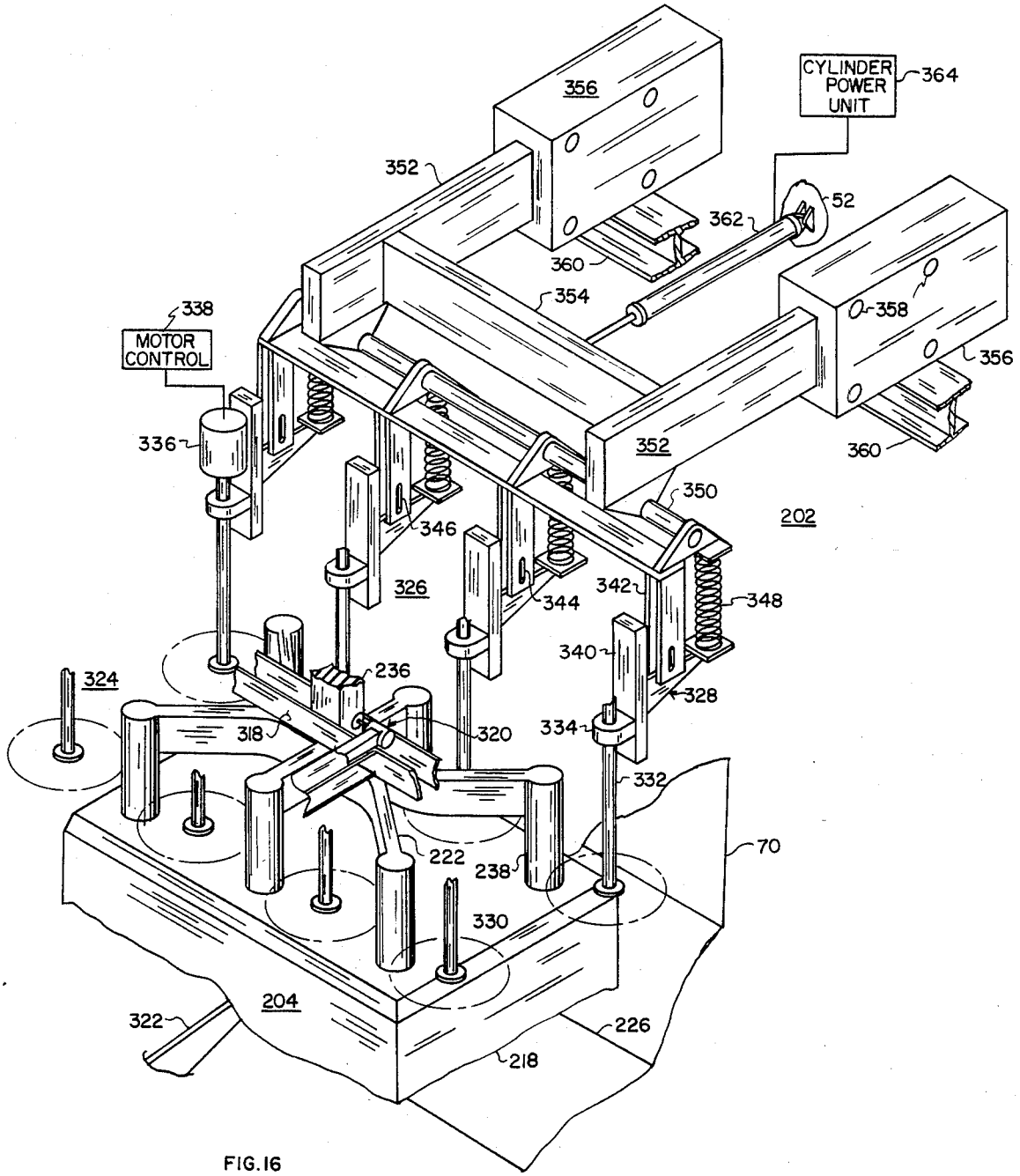
FIG. 16 is a diagrammatic view, partially cut away, of the flail assembly.

Referring now to FIG. 16, there is shown a diagrammatic view partially cut away of alternate flail assembly 202. This alternate flail assembly 202 contains many of the same components as does the flail assembly described with respect to FIGS. 1–11, and these components will retain the same reference numerals. Electrode 204 is conveyed via power and free overhead 206 through enclosure 52 and, similar to the operation of plow assembly 200, elongated rod 236 is guided between guide bars 318 and stopped by latching assembly 320. Latching assembly 320 is similar to latching assembly 240 previously described with respect to plow assembly 200 and is illustrated in greater detail in FIGS. 13 and 14 discussed above. When rod 236 is thusly retained, electrode 204 becomes disengaged from power and free overhead conveyor 206 and lever arms 322, similar in operation and construction to lever arms 210 of plow assembly 200 raise electrode 204 upward and press it against the underneath side of guide bars 318.

Two banks 324 and 326 of flailing machines 328, with bank 324 being broken away, are supported within enclosure 52 and flail the top surface of the now restrained carbon block 218, as shown. Each flailing machine 328 includes chain flailing elements 330 which are connected to and rotate about vertical shaft 332. This shaft 332 in turn is supported by bearings 334 and is rotated by motor 336 (only one shown) which is controlled by motor control 338 either automatically or manually. Motor 336 and bearings 334 are supported by member 340 which is suspended from support 342 via slot and pin connection 344. This connection 344 pivotally supports pin-supported member 340 and also enables member 340 to move vertically within slot 346. Spring 348, connected at one end to member 340, biases member 340 downward away from support 342 and also resists the pivoting of member 340 about connection 344. Spring 348 acts as a shock absorber during the flailing operation to countract the force resulting as a consequence of the flailing of carbon block 218 and also maintains the engagement of flailing elements 330 against carbon block 218. Thus, member 340, shaft 332 and flailing elements 330 are movably supported, thereby enabling each flailing machine 328 to independently conform to the shape of electrode 204.

Support 342 is suspended from pipe or structural member 350, and spring 348 is secured between pipe 350 and member 340. Pipe 350 in turn is suspended from two booms 352 which are connected together by cross beam 354. Each boom 352 is movably supported within its respective boom housing 356 by roller supports 358 which are similar to roller supports 300 of sweep plow 214 or main plows 216. These housings 356 are secured to support platform 360, and between these housings is a cylinder 362 which is secured between cross beam 354 and enclosure 52. Cylinder 362, when powered either manually or automatically by cylinder power unit 364, moves booms 352 horizontally either toward or away from electrode 204, thereby enabling bank 326 of flailing machines 328 to move towards or away from carbon block 218. Opposite bank 324 of flailing machines 328 is constructed identical to bank 326, and thus each bank 324 and 326 is movable, independently, in engagement with carbon block 218.

During operation and after electrode 204 is restrained against guide bars 318 by lever arms 322, each bank 324 and 326 of flailing machines 318 is moved toward carbon block 218. Flailing elements 330 of each flailing machine 328 are rotated to flail between posts 238 of yoke 222 and remove any alumina or cryolite encrustation from the top of carbon block 218. During the flailing operation, spring 348 of each flailing machine 328 enables each machine to independently shift or rotate slightly so as to maintain engagement with carbon block 218. The removed debris is collected in hopper 70 and transferred elsewhere by belt conveyor 226.

Once flailed, booms 352 are retracted, and latching assembly 320 is pivoted in order to enable the cleaned electrode to be conveyed by power and free conveyor 206 out of enclosure 52.

The control of flailing assembly 202 may be manual or it may be automatically controlled, such as by control panel 170 (FIG. 12). Additionally, the control of both plow assembly 200 and flailing assembly 202 may be controlled from the same control panel as indicated. The automatic operation of flailing assembly 202 may include pressure sensors, position switches, timers, etc. which in all likelihood would be used in conjunction with a computer so as to automate the operation of flailing assembly 202.

What is claimed is:

1. A carbon electrode cleaning system comprising:

first and second banks of flailing assemblies comprising:

a first plurality of horizontally spaced vertical shafts, and a second plurality of horizontally spaced vertical shafts, said first shafts being horizontally spaced from said second shafts, first motive means for rotating said first shafts in a first direction, and second motive means for rotating said second shafts in a second and opposite direction, a first plurality of flailing elements attached to said first shafts and extending horizontally when said first shafts are rotated, and a second plurality of flailing elements attached to said second shafts and extending horizontally when said second shafts are rotated;

a hopper having walls to the side of said flailing assemblies and having a bottom opening;

suspension means for vertically suspending a carbon electrode;

horizontal positioning means for horizontally and relatively positioning said shafts of said flailing assemblies and said carbon electrode;

vertical positioning means for vertically and relatively positioning said flailing elements and said carbon electrode; and said suspension means includes means for horizontally moving a said carbon electrode along a path including, in order, a first station and second station, and wherein said banks of said flailing assemblies are generally located at said second station, and said cleaning system further comprising an electrode scraping system located at said first station, and said scraping system comprising:

a support stand, scraping means supported by said support stand for applying a scraping force to a said carbon electrode, guide means for relatively positioning said support stand and a said electrode, confining means for selectively confining the movement of a said electrode while said scraping means is operated across a surface of said electrode, and said suspension means includes a hoist supporting said electrode, an overhead conveyor supporting said hoist, and said overhead conveyor being positioned to extend through said first and second stations.

2. A carbon electrode cleaning system as set forth in claim 1 wherein said guide means includes a pair of spaced, elongated, guide bars.

3. A carbon electrode cleaning system as set forth in claim 2 wherein said confining means includes latching means secured to said guide means for restraining the movement of said electrode.

4. A carbon electrode cleaning system as set forth in claim 1 wherein said confining means includes horizontal restraining means and vertical restraining means for, respectively, horizontally and vertically restraining a said electrode relative to said scraping means.

5. A carbon electrode cleaning system as set forth in claim 4 wherein said scraping means includes a plow blade, and wherein said vertical restraining means includes vertical positioning means for vertically and relatively positioning said electrode and said plow blade.

6. A carbon electrode cleaning system as set forth in claim 5 wherein said cleaning system is adapted to clean a carbon electrode having a yoke secured to said electrode, and said horizontal restraining means includes means for engaging said yoke.

7. A carbon electrode cleaning system as set forth in claim 1 wherein said scraping means includes first, second and third plows, each said plow having an extendable boom and including first, second and third plow blades supported on said boom.

8. A carbon electrode cleaning system as set forth in claim 7 wherein a said first plow blade is oriented to scrap along a first directional area of said electrode, and said second and third plow blades are oriented to scrap in a direction transverse to said first-named direction.

9. A carbon electrode cleaning system comprising:

a flailing assembly comprising:

at least one first vertical shaft and at least one second vertical shaft, a said first shaft being horizontally spaced from said second shaft, first motive means for rotating a said first shaft in a first direction, and second motive means for rotating a said second shaft in a second and opposite direction, a first plurality of flailing elements attached to a said first shaft and extending horizontally when a said first shaft is rotated, and a second plurality of flailing elements attached to a said second shaft and extending horizontally when a said second shaft is rotated;

a hopper having walls to the side of said flailing assemblies and having a bottom opening;

suspension means for vertically suspending a carbon electrode;

horizontal positioning means for horizontally and relatively positioning said shafts of said flailing assemblies and said carbon electrode;

vertical positioning means for vertically and relatively positioning said flailing elements and said carbon electrode; and said suspension means includes means for horizontally moving a said carbon electrode along a path including, in order, a first station and second station, and wherein said banks of said flailing assemblies are generally located at said second station, and said cleaning system further comprising an electrode scraping system located at said first station, and said scraping system comprising:

a support stand, scraping means supported by said support stand for applying a scraping force to a said carbon electrode, guide means for relatively positioning said support stand and a said electrode, confining means for selectively confining the movement of a said electrode while said scraping means is operated across a surface of said electrode, and said suspension means includes a hoist supporting said electrode, an overhead conveyor supporting said hoist, and said overhead conveyor being positioned to extend through said first and second stations.

10. A carbon electrode cleaning system as set forth in claim 9 wherein said guide means includes a pair of spaced, elongated, guide bars.

11. A carbon electrode cleaning system as set forth in claim 10 wherein said confining means includes latching means secured to said guide means for restraining the movement of said electrode.

12. A carbon electrode cleaning system as set forth in claim 9 wherein said confining means includes horizontal restraining means and vertical restraining means for, respectively, horizontally and vertically restraining a said electrode relative to said scraping means.

13. A carbon electrode cleaning system as set forth in claim 12 wherein said scraping means includes a plow blade, and wherein said vertical restraining means includes vertical positioning means for vertically and relatively positioning said electrode and said plow blade.

14. A carbon electrode cleaning system as set forth in claim 13 wherein said cleaning system is adapted to clean a carbon electrode having a yoke secured to said electrode, and said horizontal restraining means includes means for engaging said yoke.

15. A carbon electrode cleaning system as set forth in claim 9 wherein said scraping means includes first, second and third plows, each said plow having an extendable boom and including first, second and third plow blades supported on said boom.

16. A carbon electrode cleaning system as set forth in claim 15 wherein a said first plow blade is oriented to scrap along a first directional area of said electrode, and said second and third plow blades are oriented to scrap in a direction transverse to said first-named direction.

* * * * *